US009502772B2

(12) United States Patent
Chen et al.

(10) Patent No.: US 9,502,772 B2
(45) Date of Patent: Nov. 22, 2016

(54) ANTENNA STRUCTURE AND WIRELESS COMMUNICATION DEVICE USING THE SAME

(71) Applicant: Chiun Mai Communication Systems, Inc., New Taipei (TW)

(72) Inventors: Jin-Bo Chen, New Taipei (TW); Che-Yen Lin, New Taipei (TW); Cho-Kang Hsu, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 420 days.

(21) Appl. No.: 14/061,929

(22) Filed: Oct. 24, 2013

(65) Prior Publication Data

US 2014/0354497 A1 Dec. 4, 2014

(30) Foreign Application Priority Data

Jun. 4, 2013 (TW) ..... 102119701 A

(51) Int. Cl.

| | |
|---|---|
| ***H01Q 13/10*** | (2006.01) |
| ***H01Q 5/378*** | (2015.01) |
| ***H01Q 9/42*** | (2006.01) |
| *H01Q 1/24* | (2006.01) |
| *H01Q 5/371* | (2015.01) |

(52) U.S. Cl.

CPC ..... *H01Q 5/378* (2015.01); *H01Q 9/42* (2013.01); *H01Q 1/243* (2013.01); *H01Q 5/371* (2015.01)

(58) Field of Classification Search

CPC ..... H01Q 13/10; H01Q 9/42

USPC ..... 343/770

See application file for complete search history.

(56) References Cited

U.S. PATENT DOCUMENTS

| | | | | |
|---|---|---|---|---|
| 7,764,236 | B2 * | 7/2010 | Hill | H01Q 1/243 343/702 |
| 8,405,557 | B2 * | 3/2013 | Lu | H01Q 9/26 343/700 MS |
| 8,441,399 | B2 * | 5/2013 | Wu | H01Q 1/2258 343/700 MS |
| 2003/0189522 | A1 * | 10/2003 | Zeilinger | H01Q 9/0421 343/702 |
| 2004/0041734 | A1 * | 3/2004 | Shiotsu | G06F 1/1616 343/702 |
| 2009/0153409 | A1 * | 6/2009 | Chiang | H01Q 1/243 343/702 |
| 2012/0262342 | A1 | 10/2012 | Lee | |

FOREIGN PATENT DOCUMENTS

| | | |
|---|---|---|
| TW | 201132119 | 9/2011 |

* cited by examiner

*Primary Examiner* — Dameon E Levi
*Assistant Examiner* — Hasan Islam
(74) *Attorney, Agent, or Firm* — Zhigang Ma

(57) ABSTRACT

An antenna structure includes a feed section, a ground section, a first radiator, a second radiator, and a third radiator. The first radiator and the second radiator are both connected to the feed section. The third radiator is connected to the ground section. The first radiator defines a first slot. A second slot is defined between the second radiator and the third radiator. The third radiator defines a third slot. The third slot communicates with the second slot. Current is coupled from the first radiator and the second radiator to the third radiator via the first slot, the second slot, and the third slot.

20 Claims, 3 Drawing Sheets

ANTENNA STRUCTURE AND WIRELESS COMMUNICATION DEVICE USING THE SAME

BACKGROUND

1. Technical Field

The disclosure generally relates to antenna structures, and particularly to an antenna structure for receiving/transmitting dual-band wireless signals or multiband wireless signals and a wireless communication device using the same.

2. Description of Related Art

Antennas are used in wireless communication devices, such as mobile phones. A wireless communication device uses a multiband antenna to receive/transmit wireless signals at different frequencies. However, many multiband antennas have complicated structures and are large in size, thereby making it difficult to miniaturize the wireless communication devices.

Therefore, there is room for improvement within the art.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the disclosure. Moreover, in the drawings, like reference numerals designate corresponding parts throughout the views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

Figure 1:
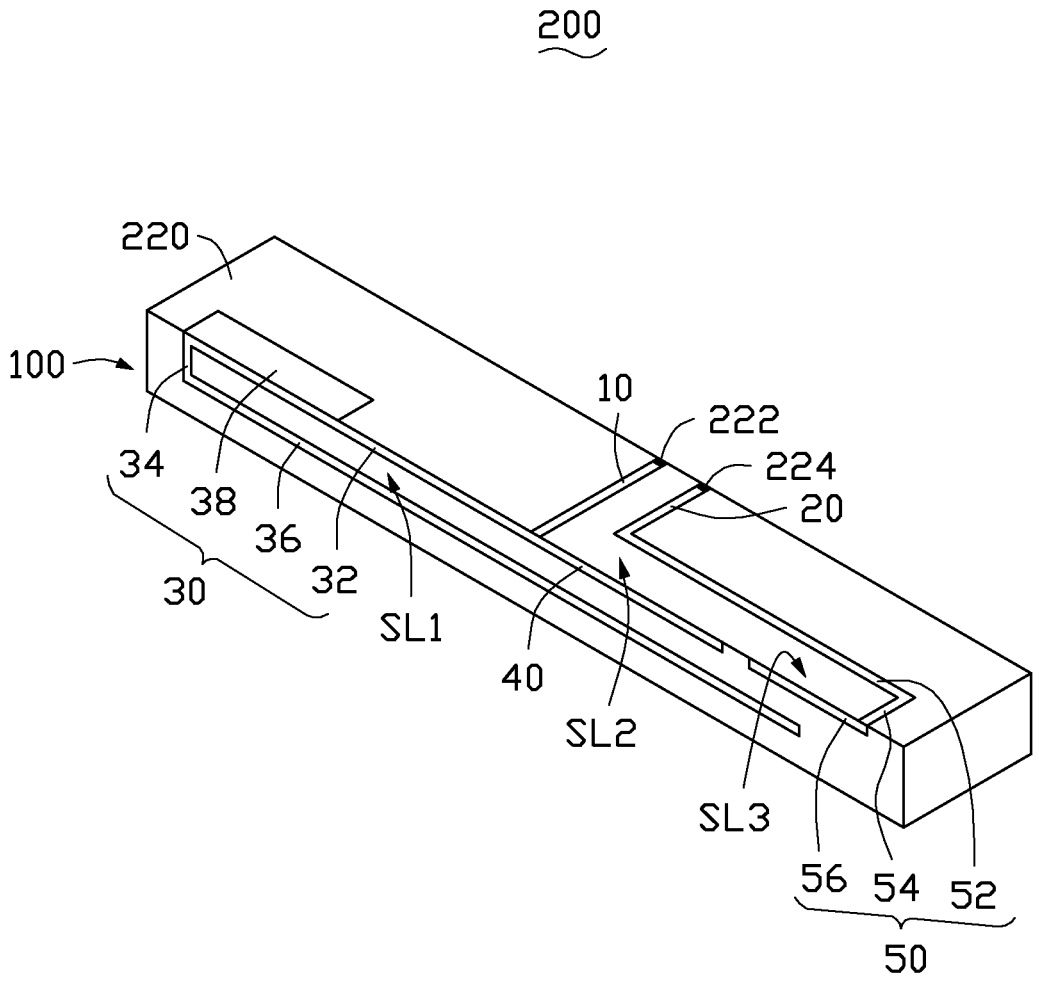
FIG. 1 is an assembled view of a wireless communication device employing an antenna structure, according to an exemplary embodiment.

FIG. 1 shows a wireless communication device 200 employing an antenna structure 100, according to an exemplary embodiment. The wireless communication device 200 may be a mobile phone or a personal digital assistant, for example. The wireless communication device 200 further includes a circuit board 220. The circuit board 220 forms a feed pin 222 and a ground pin 224. The feed pin 222 is configured to provide current to the antenna structure 100, and the ground pin 224 grounds the antenna structure 100.

The antenna structure 100 is formed on the circuit board 220 and includes a feed section 10, a ground section 20, a first radiator 30, a second radiator 40, and a third radiator 50. The feed section 10 is electronically connected to the feed pin 222 to receive the current. The ground section 20 is substantially parallel to the feed section 10 and is electronically connected to the ground pin 224.

The first radiator 30 is connected to the feed section 10 to cooperatively form a monopole. The first radiator 30 includes a first extending section 32, a second extending section 34, a third extending section 36, and an extending sheet 38. The first extending section 32 is connected substantially perpendicularly to the feed section 10. The second extending section 34 is connected substantially perpendicularly between the first extending section 32 and the third extending section 36, thereby defining a first gap SL1 between the first extending section 32 and the third extending section 36. The third extending section 36 and the first extending section 32 are substantially parallel to each other. The extending sheet 38 is adjacent to the second extending section 34 and extends from a side of the first extending section 32 opposite to the third extending section 36.

The second radiator 40 is collinearly connected to an end of the first extending section 32. An end of the feed section 10 is connected to the second radiator 40 and the first extending section 32 at a junction of the first extending section 32 and the second radiator 40. The feed section 10 and the second radiator 40 cooperatively form a monopole. In one exemplary embodiment, a length of the third extending section 36 is greater than a combined length of the first extending section 32 and the second radiator 40.

The third radiator 50 includes a first connection section 52, a second connection section 54, and a third connection section 56. The first connection section 52 is connected substantially perpendicularly to the ground section 20 and extends substantially parallel to the second radiator 40. The first connection section 52 and the second radiator 40 cooperatively define a second gap SL2. The second connection section 54 is connected substantially perpendicularly between the first connection section 52 and the third connection section 56. The first, second, and third connection sections 52, 54, 56 cooperatively define a third gap SL3. The third gap SL3 communicates with the second gap SL2. The third connection section 56 extends towards the second radiator 40 until the third connection section 56 overlaps with an orthographic projection of the third extending section 36.

The feed section 10, the ground section 20, the extending sheet 38, the first connection section 52, and the second connection section 54 are installed on a first surface (not labeled) of the circuit board 220. The first extending section 32, the second extending section 34, the third extending section 36, the second radiator 40, and the third connection section 56 are installed on a second surface (not labeled) of the circuit board 220. The second surface is substantially perpendicular to the first surface. The antenna structure 100 is installed on the circuit board 220, which effectively reduces a required size and production cost of the wireless communication device 200.

When the current is input to the feed section 10, the current flows to the first radiator 30 and activates the first radiator 30 to receive and transmit wireless signals, such as LTE700, GSM850, EGSM900, WCDMA V, and WCDMA VIII at a first central frequency band. The current then flows to and activates the second radiator 40. Moreover, the current is coupled from the first radiator 30 and the second radiator 40 to the third radiator 50 via the first slot SL1, the second slot SL2, and the third slot SL3 to activate the third radiator 50. Thus, the second radiator 40 and the third radiator 50 cooperatively receive and transmit wireless signals, such as DCS, PCS, UMTS, WCDMA I, WCDMA II, and WCDMA IV at a second central frequency band.

Figure 2:
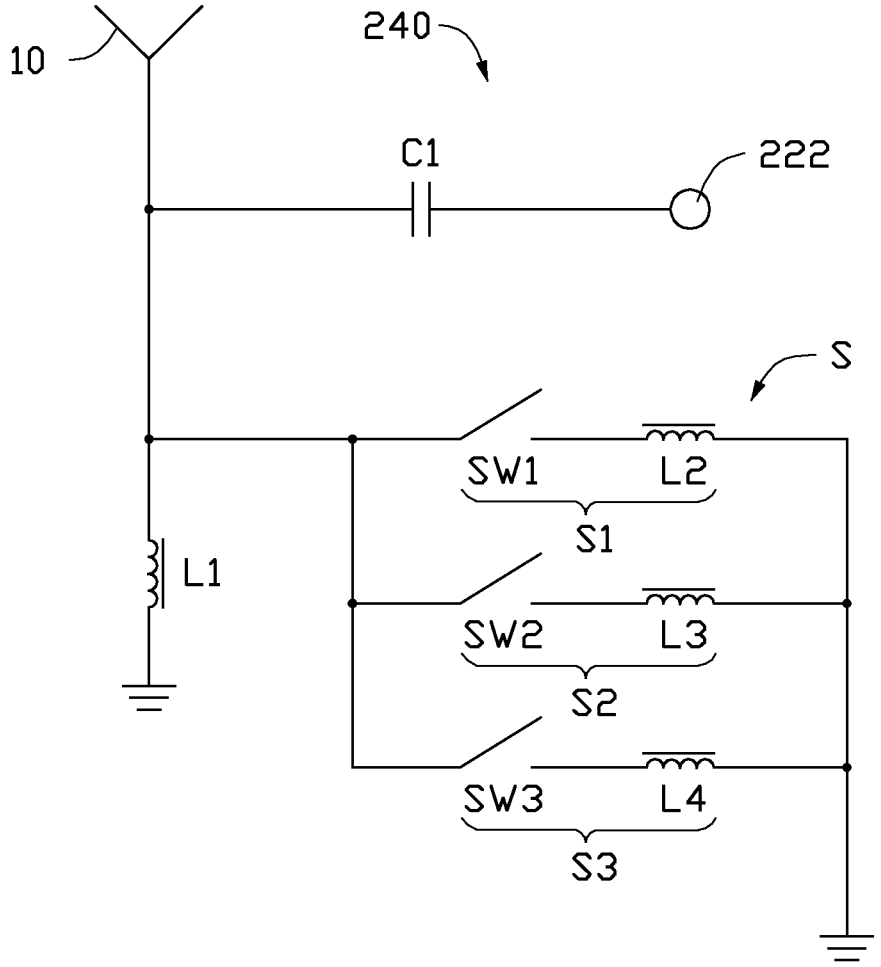
FIG. 2 is circuit view of a matching circuit of the wireless communication device of FIG. 1.

Referring to FIG. 2, the wireless communication device 200 further includes a matching circuit 240. The matching circuit 240 is configured to optimize performance of the antenna structure 100 when the antenna structure 100 transmits or receives wireless signals at the first central frequency band. The matching circuit 240 is electronically connected between the feed pin 222 and the feed section 10.

The matching circuit 240 includes a first capacitor C1, a first inductor L1, and a switching circuit S. The first capacitor C1 is electronically connected between the feed pin 222 and the feed section 10. The first inductor L1 is electronically connected between the feed section 10 and ground. A first node of the switching circuit S is electronically connected between the feed section 10 and the first inductor L1, and a second node of the switching circuit S is ground.

In one exemplary embodiment, the switching circuit S includes a first switching unit S1, a second switching unit S2, and a third switching unit S3 electronically. The first switching unit S1, the second switching unit S2, and the third switching unit S3 are connected in parallel. The first switching unit S1 includes a first switch SW1 and a second inductor L2 connected in series to the first switch SW1. The second switching unit S2 includes a second switch SW2 and a third inductor L3 connected in series to the second switch SW2. The third switching unit S3 includes a third switch SW3 and a fourth inductor L4 connected in series to the third switch SW3. Circuit parameters of the matching circuit 240, such as an inductance of the second inductor L2, the third inductor L3, and the fourth inductor L4, are adjusted to ensure that the antenna structure 100 has good performance when receiving or transmitting signals at the first central frequency band. For example, when the antenna structure 100 operates at LTE700, if the performance needs to be optimized, the first switch SW1 is turned on, and the second switch SW2 and the third switch SW3 are turned off. Then, the second inductor L2 is activated, and an impedance of the matching circuit 240 is changed to suit LTE700. When the antenna structure 100 operates at EGSM900, if the performance needs to be optimized, the first switch SW1 and the second switch SW2 are turned off, and the third switch SW3 is turned on. Then, the fourth inductor L4 is activated, and an impedance of the matching circuit 240 is changed to suit EGSM900.

Figure 3:
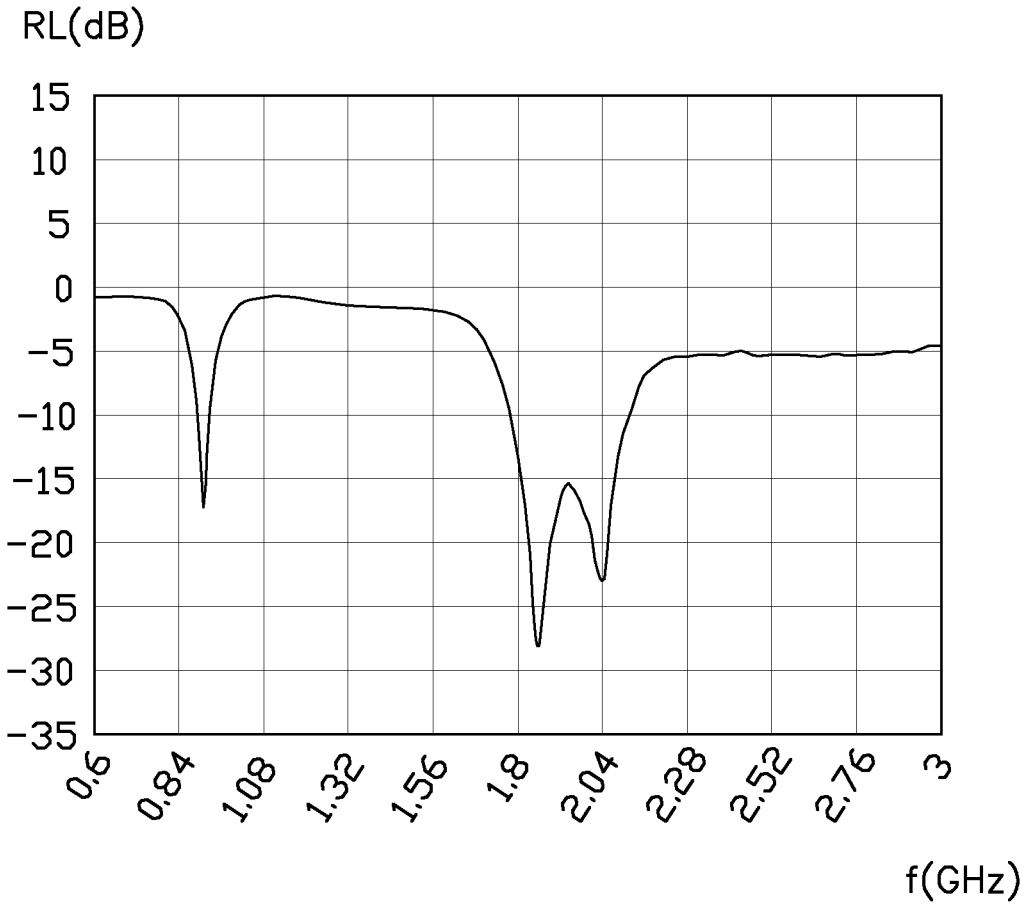
FIG. 3 is a return loss (RL) graph of the wireless communication device of FIG. 1.

FIG. 3 is a return loss (RL) graph of the wireless communication device 200 when the third switch SW3 is turned on. The wireless communication device 200 has good performance when receiving/transmitting signals at the first central frequency band of about 704 MHz to about 960 MHz, and also has good performance when operating at the second central frequency band of about 1710 MHz to about 2170 MHz.

In summary, the first radiator 30 and the second radiator 40 are coupled to the third radiator 50, to allow the antenna structure 100 to receive/transmit dual-band wireless signals or multiband wireless signals. Thus, the wireless communication device 200 does not require any additional antennas, which effectively reduces a required size of the wireless communication device 200. In addition, a radiating capability of the antenna structure 100 of the wireless communication device 200 is effectively improved because of the matching circuit 240.

It is to be understood, however, that even through numerous characteristics and advantages of the present disclosure have been set forth in the foregoing description, together with details of assembly and function, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. An antenna structure, comprising:

a feed section;

a ground section;

a first radiator;

a second radiator, the second radiator and the first radiator connected to two opposite sides of the feed section; and a third radiator connected to the ground section;

wherein the first radiator defines a first slot, a second slot is defined between the second radiator and the third radiator, the third radiator defines a third slot, the third slot communicates with the second slot, current is coupled from the first radiator and the second radiator to the third radiator via the first slot, the second slot, and the third slot;

wherein the first radiator comprises a first extending section, a second extending section, and a third extending section, the first extending section is perpendicularly connected to the feed section, the second extending section is perpendicularly connected between the first extending section and the third extending section, the third extending section and the first extending section are positioned parallel to each other;

wherein the feed section and the ground section are positioned in a first plane, the first, second, and third extending sections are positioned in a second plane substantially perpendicular to the first plane.

2. The antenna structure as claimed in claim 1, wherein the first radiator further comprises an extending sheet, the extending sheet is adjacent to the second extending section and extends from a side of the first extending section opposite to the third extending section, the extending sheet is positioned in the first plane.

3. The antenna structure as claimed in claim 1, wherein the second radiator is collinearly connected to an end of the first extending section, the second radiator is positioned in the second plane.

4. The antenna structure as claimed in claim 3, wherein a length of the third extending section is greater than a combined length of the first extending section and the second radiator.

5. The antenna structure as claimed in claim 4, wherein the third radiator comprises a first connection section, a second connection section, and a third connection section, the first connection section is perpendicularly connected to the ground section, and extends parallel to the second radiator, the second connection section is perpendicularly connected between the first connection section and the third connection section, the third connection section extends towards the second radiator until the third connection section overlaps with an orthographic projection of the third extending section, the first and second connection sections are positioned in the first plane, the third connection is positioned in the second plane.

6. The antenna structure as claimed in claim 5, wherein the second gap is defined between the second radiator and the first connection section of the third radiator.

7. A wireless communication device, comprising:

a circuit board, comprising a first surface and a second surface substantially perpendicular connected to the first surface; and an antenna structure located on the circuit board, the antenna structure comprising:

a feed section;

a ground section;

a first radiator;

a second radiator, the second radiator and the first radiator connected to two opposite sides of the feed section; and a third radiator connected to the ground section;

wherein the first radiator defines a first slot, a second slot is defined between the second radiator and the third radiator, the third radiator defines a third slot, the third slot communicates with the second slot, current is coupled from the first radiator and the second radiator to the third radiator via the first slot, the second slot, and the third slot;

wherein the first radiator comprises a first extending section, a second extending section, and a third extending section, the first extending section is perpendicularly connected to the feed section, the second extending section is perpendicularly connected between the first extending section and the third extending section, the third extending section and the first extending section are positioned parallel to each other;

wherein the feed section and the ground section attached to the first surface, the feed section and the ground section attached to the first surface the first, second, and third extending sections are attached to the second surface.

8. The wireless communication device as claimed in claim 7, wherein the first radiator further comprises an extending sheet, the extending sheet is adjacent to the second extending section and extends from a side of the first extending section opposite to the third extending section, the extending sheet is attached to the first surface.

9. The wireless communication device as claimed in claim 7, wherein the second radiator is collinearly connected to an end of the first extending section, the second radiator is attached to the second surface.

10. The wireless communication device as claimed in claim 9, wherein a length of the third extending section is greater than a combined length of the first extending section and the second radiator.

11. The wireless communication device as claimed in claim 10, wherein the third radiator comprises a first connection section, a second connection section, and a third connection section, the first connection section is perpendicularly connected to the ground section, and extends parallel to the second radiator, the second connection section is perpendicularly connected between the first connection section and the third connection section, the third connection section extends towards the second radiator until the third connection section overlaps with an orthographic projection of the third extending section, the first and second connection sections is attached to the first surface, the third connection is attached to the second surface.

12. The wireless communication device as claimed in claim 11, wherein the second gap is defined between the second radiator and the first connection section of the third radiator.

13. The wireless communication device as claimed in claim 7, wherein the circuit board includes a feed pin, the wireless communication device further comprises a matching circuit, the matching circuit is electronically connected between the feed pin and the feed section.

14. The wireless communication device as claimed in claim 13, wherein the matching circuit comprises a first capacitor, a first inductor, and a switching circuit, the first capacitor is electronically connected between the feed pin and the feed section, the first inductor is electronically connected between the feed section and ground, a first node of the switching circuit is electronically connected between the feed section and the first inductor, a second node of the switching circuit is ground.

15. The wireless communication device as claimed in claim 14, wherein the switching circuit comprises a first switching unit, a second switching unit, and a third switching unit electronically connected to the first switching unit and the second switching unit in parallel, the first switching unit comprises a first switch and a second inductor connected in series to the first switch, the second switching unit comprises a second switch and a third inductor connected in series to the second switch, the third switching unit comprises a third switch and a fourth inductor connected in series to the third switch.

16. An antenna structure, comprising:

a feed section;

a ground section;

a first radiator;

a second radiator, the second radiator and the first radiator connected to two opposite sides of the feed section; and a third radiator connected to the ground section;

wherein the first radiator defines a first slot, a second slot is defined between the second radiator and the third radiator, the third radiator defines a third slot, the third slot communicates with the second slot, current is coupled from the first radiator and the second radiator to the third radiator via the first slot, the second slot, and the third slot;

wherein the first radiator comprises a first extending section, a second extending section, and a third extending section, the first extending section is perpendicularly connected to the feed section, the second extending section is perpendicularly connected between the first extending section and the third extending section, the third extending section and the first extending section are positioned parallel to each other;

wherein the third radiator comprises a first connection section, a second connection section, and a third connection section, the first connection section is perpendicularly connected to the ground section, and extends parallel to the second radiator, the second connection section is perpendicularly connected between the first connection section and the third connection section, the third connection section extends towards the second radiator until the third connection section overlaps with an orthographic projection of the third extending section;

wherein the feed section, the ground section, and the first and second connection sections are positioned in a first plane; wherein the first, second, and third extending sections, the second radiator, and the third connection section are positioned in a second plane substantially perpendicular to the first plane.

17. The antenna structure as claimed in claim 16, wherein the first radiator further comprises an extending sheet, the extending sheet is adjacent to the second extending section and extends from a side of the first extending section opposite to the third extending section, the extending sheet is positioned in the first plane.

18. The antenna structure as claimed in claim 16, wherein the second radiator is collinearly connected to an end of the first extending section.

19. The antenna structure as claimed in claim 16, wherein a length of the third extending section is greater than a combined length of the first extending section and the second radiator.

20. The antenna structure as claimed in claim 16, wherein the second gap is defined between the second radiator and the first connection section of the third radiator.

* * * * *